US006022025A

United States Patent [19]

Chuang

[11] Patent Number: 6,022,025

[45] Date of Patent: Feb. 8, 2000

[54] FISHING TOY

[76] Inventor: Chuan-Tien Chuang, No. 40, Lane. 174, Da-Shing St., Tainan, Taiwan

[21] Appl. No.: 09/159,590

[22] Filed: Sep. 24, 1998

[51] Int. Cl.[7] ..... A63F 9/00

[52] U.S. Cl. ..... 273/448; 273/443; 273/456; 446/158

[58] Field of Search ..... 273/443, 447, 273/448, 456, 459, 460; 446/153, 156, 158, 376

[56] References Cited

U.S. PATENT DOCUMENTS

| | | | |
|---|---|---|---|
| 2,909,868 | 10/1959 | Lewis | 273/448 X |
| 2,933,315 | 4/1960 | Carr, Jr. | 273/447 |
| 3,077,698 | 2/1963 | Glass et al. | 446/158 |
| 4,272,075 | 6/1981 | Rogers, Jr. | 273/448 |
| 4,832,650 | 5/1989 | Tong | 446/156 |
| 5,050,876 | 9/1991 | Chuang | 273/456 |
| 5,775,022 | 7/1998 | Sumrall et al. | 446/156 X |

*Primary Examiner*—Raleigh W. Chiu
*Attorney, Agent, or Firm*—Bacon & Thomas, PLLC

[57] ABSTRACT

A fishing toy including a fishing tackle and a toy fish. When the fishing line is wound on a line-winding mechanism of the fishing tackle to the end, the line-winding mechanism will idle to protect the fishing line and the fishing rod. When a switch is switched on, a motor in the toy fish is rotated to drive a swinging mechanism and a linking mechanism, whereby the toy fish can slowly swing and swim in the water with the lower jaw slowly opening and closing. When a magnetic bait attracts and attaches to the bite triggering mechanism, the fish tail and the lower jaw swing more violently so as to create a live effect both when the toy fish is in the water and after it is gaffed.

8 Claims, 10 Drawing Sheets

FISHING TOY

BACKGROUND OF THE INVENTION

The present invention relates to a fishing toy which can create a live effect.

In the conventional fishing toy, when the toy fish is placed in the water, the toy fish is in a still state and waits to be gaffed without swimming in the water. When gaffed, the tail of the toy fish can swing back and forth. However, in the event the tail is constrained from swinging after being gaffed, the internal motor and gears in the toy fish are subject to damage. This will shorten the useful life of the fishing toy. Moreover, the line-winding mechanism of the fishing tackle cannot idle when the fishing line is wound to the end. This often leads to breakage of the fishing line and the fishing rod.

SUMMARY OF THE INVENTION

It is a primary object of the present invention to provide a fishing toy in which the toy fish can swim in the water with the lower jaw moving up and down. In addition, when gaffed, the toy fish will in a lively manner.

It is a further object of the present invention to provide the above fishing toy in which the line-winding mechanism can protect the fishing line and the fishing rod.

It is still a further object of the present invention to provide the above fishing toy in which a fin switch is used to make the toy fish swim in the water without exposing the power switch.

It is still a further object of the present invention to provide the above fishing toy in which a protection mechanism is provided to prolong the useful life of the fishing toy.

According to the above objects, the fishing toy of the present invention includes a fishing tackle and a toy fish. A fishing line is passed through the fishing tackle. A front end of the fishing line is disposed with a float and a magnetic bait. A rear end of the fishing line is wound on a line-winding mechanism. The toy fish includes a sinking motor, a battery assembly, a bite triggering mechanism, a swinging mechanism, a linking mechanism and a fin switch. By means of moving the fin switch, the motor is powered on and rotated to drive the swinging mechanism and the linking mechanism. The swinging mechanism is connected with a tail swinging block and the linking mechanism is connected with a lower jaw. When the swinging block swings left and right, the toy fish can swing and swim in the water. The lower jaw is driven by the linking mechanism to move up and down. When the magnetic bait attracts and attaches to the bite triggering mechanism, the switch is triggered, whereby the motor rotates at higher speed and the tail swinging block and the lower jaw more violently swing to create a live effect. In the case that the swinging mechanism and the linking mechanism are constrained by external force from swinging, the protection device in the toy fish will create an idling effect so as to avoid damage of the swinging mechanism and the linking mechanism and prolong the useful life. In addition, when the fishing line is wound by the line-winding mechanism to the end, the line-winding mechanism will idle to protect the fishing line and fishing rod.

The present invention can be best understood through the following description and accompanying drawings, wherein:

DETAILED DESCRIPTION OF THE PREFERRED EMBODIMENT

Figure 1:
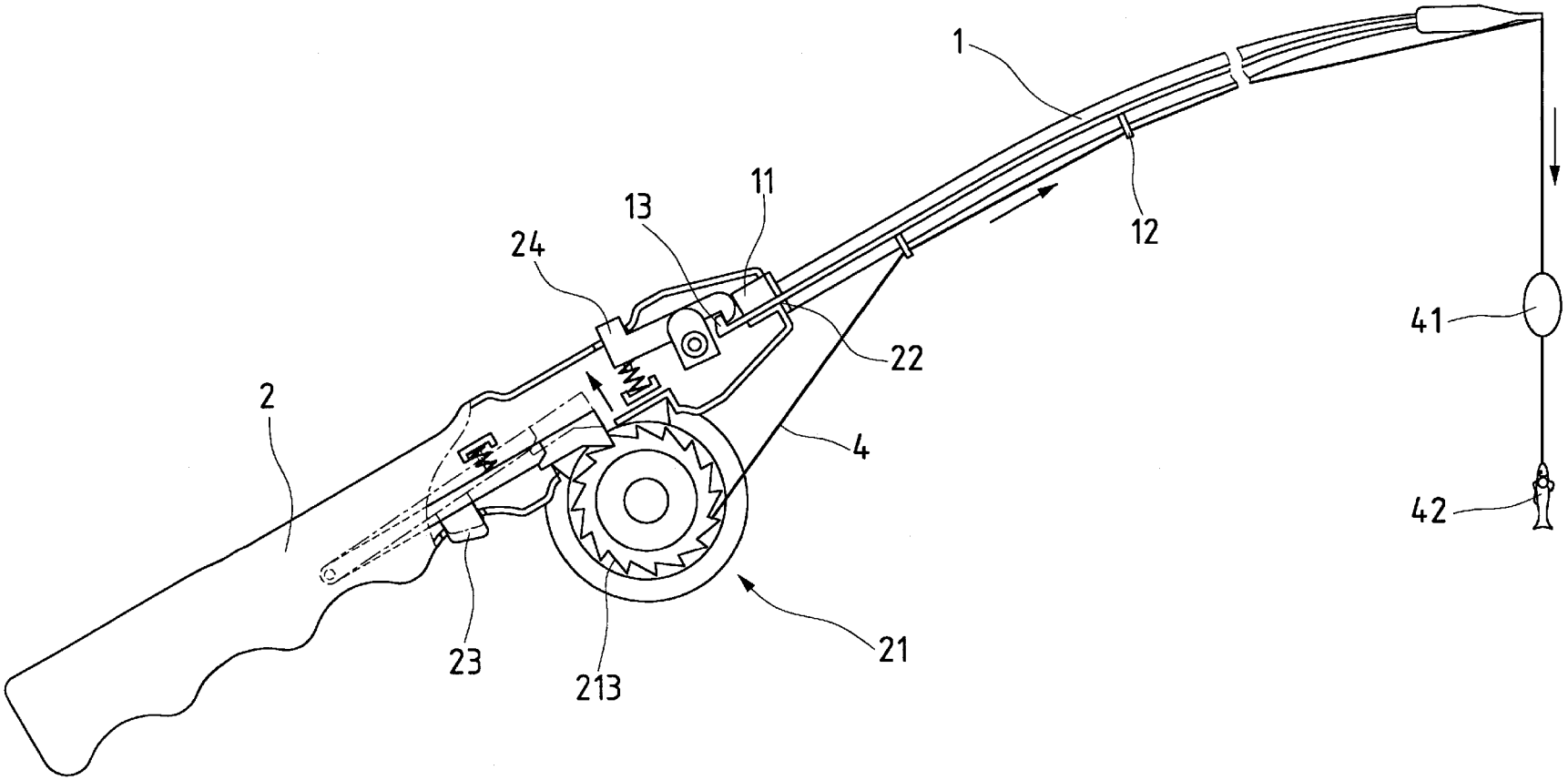
FIG. 1 is a partially sectional view of the fishing tackle of the present invention.
Figure 8:
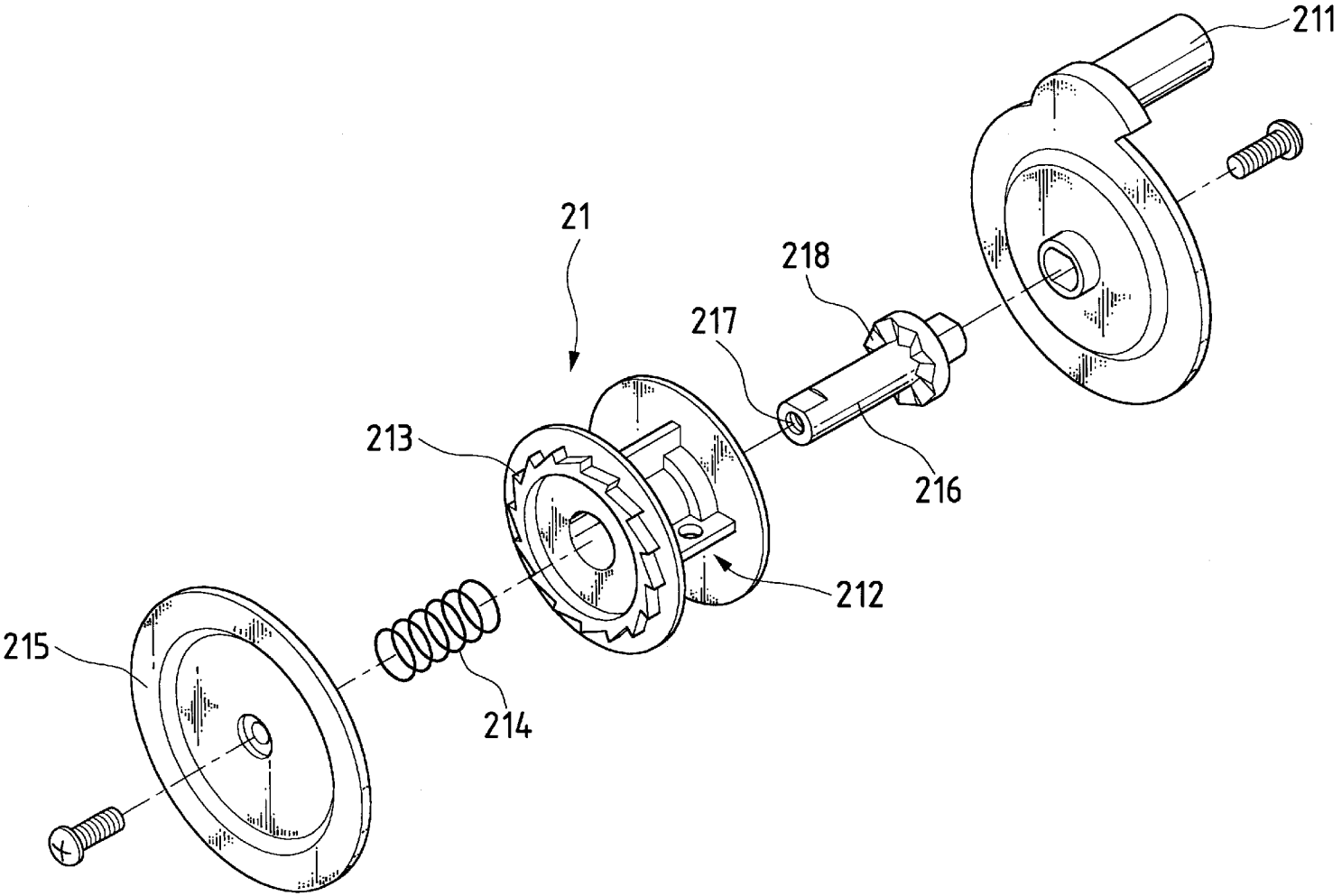
FIG. 8 is a perspective exploded view of the line-winding mechanism of the present invention.

Please refer to FIGS. 1 and 8. The fishing toy of the present invention includes a fishing rod 1, a separable grip 2 and a toy fish 5 (or shrimp, turtle, etc.). One end of the fishing rod 1 is formed with an insertion end 11. Multiple line holes 12 are arranged on the fishing rod 1 at intervals for a fishing line 4 to pass therethrough. A front end of the fishing line 4 is disposed with a float 41 and a magnetic fishing bait 42. The grip 2 is equipped with a line-winding mechanism 21 around which the fishing line 4 is wound. The line-winding mechanism 21 includes a reel 212, a spring 214 and a rotary shaft 216 passed through the reel 212. A ratchet cover 215 and a cap member with a handle 211 are respectively coupled with two ends of the reel 212 by screws. A front end of the grip 2 is formed with an insertion hole 22 for inserting the fishing rod 1 therein. When not used, the fishing rod 1 is detached from the grip to reduce the volume for easy storage. The grip 2 is disposed with a releasing button 23 for the line-winding mechanism 21 to release and unwind the fishing line 4. An unlocking button 24 is used to separate the fishing rod 1 from the grip 2.

Figure 2:
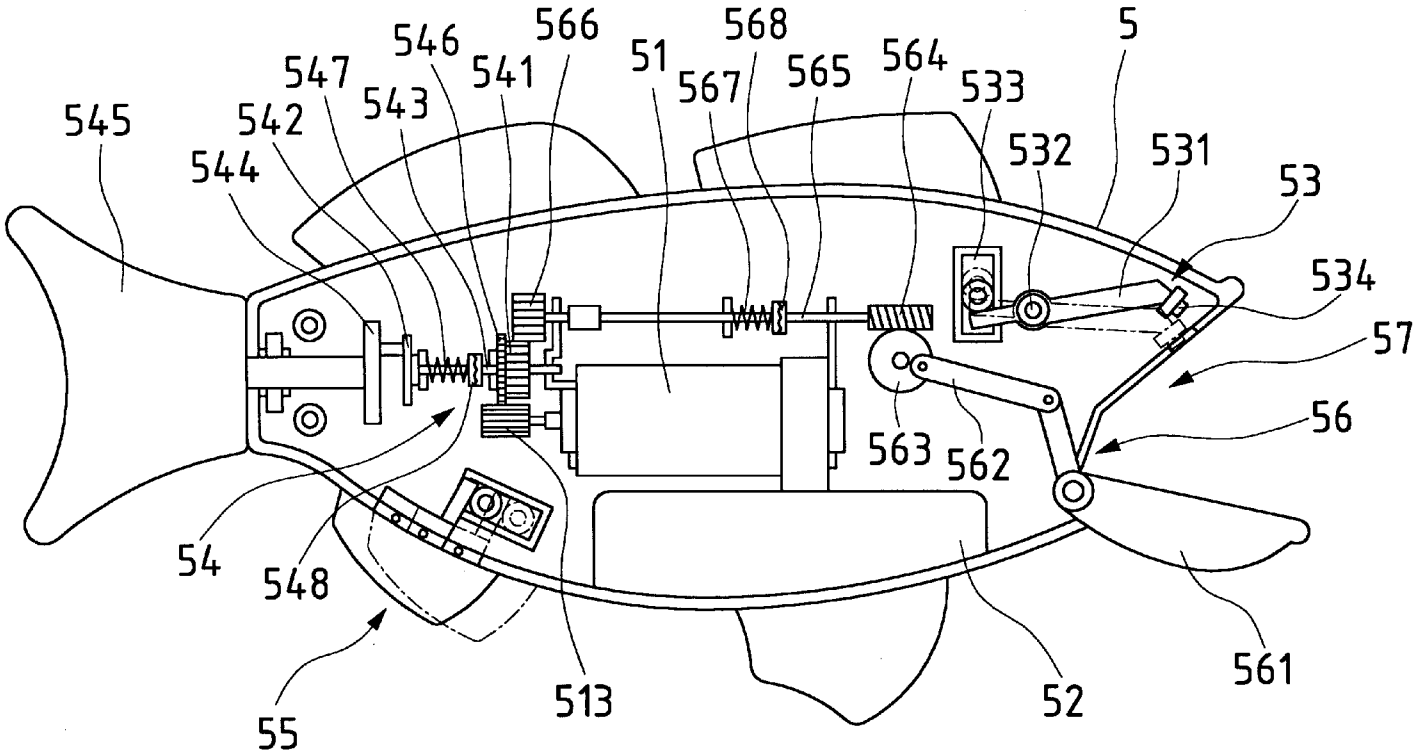
FIG. 2 is a sectional view of the toy fish of the present invention.
Figure 3:
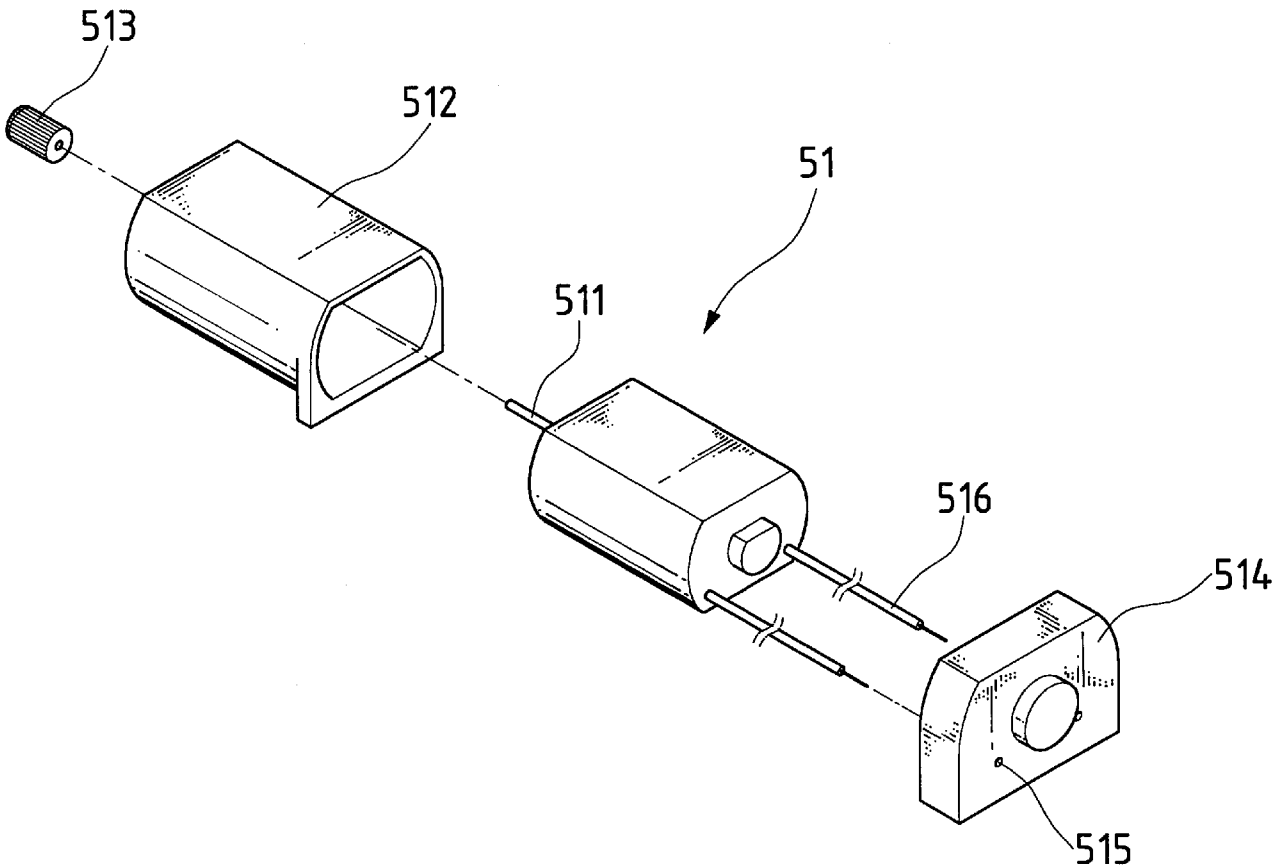
FIG. 3 is a perspective exploded view of the sinking motor of the present invention.

Referring to FIG. 2, the toy fish 5 includes a sinking motor 51, a battery assembly 52, a bite triggering mechanism 53, a swinging mechanism 54, a fin switch 55 and a linking mechanism 56. The sinking motor is enclosed in a motor sheath 512 and a motor cap 514 to achieve a waterproof effect. The motor sheath 512 and motor cap 514 are formed with shaft hole and line hole 515. The motor shaft 511 is fitted with a toothed sleeve 513 meshing with a reducing gear 546 of the swinging mechanism 54. A second transmission gear 566 of the linking mechanism 56 is engaged with a gear set 541 of the swinging mechanism 54.

Figure 4:
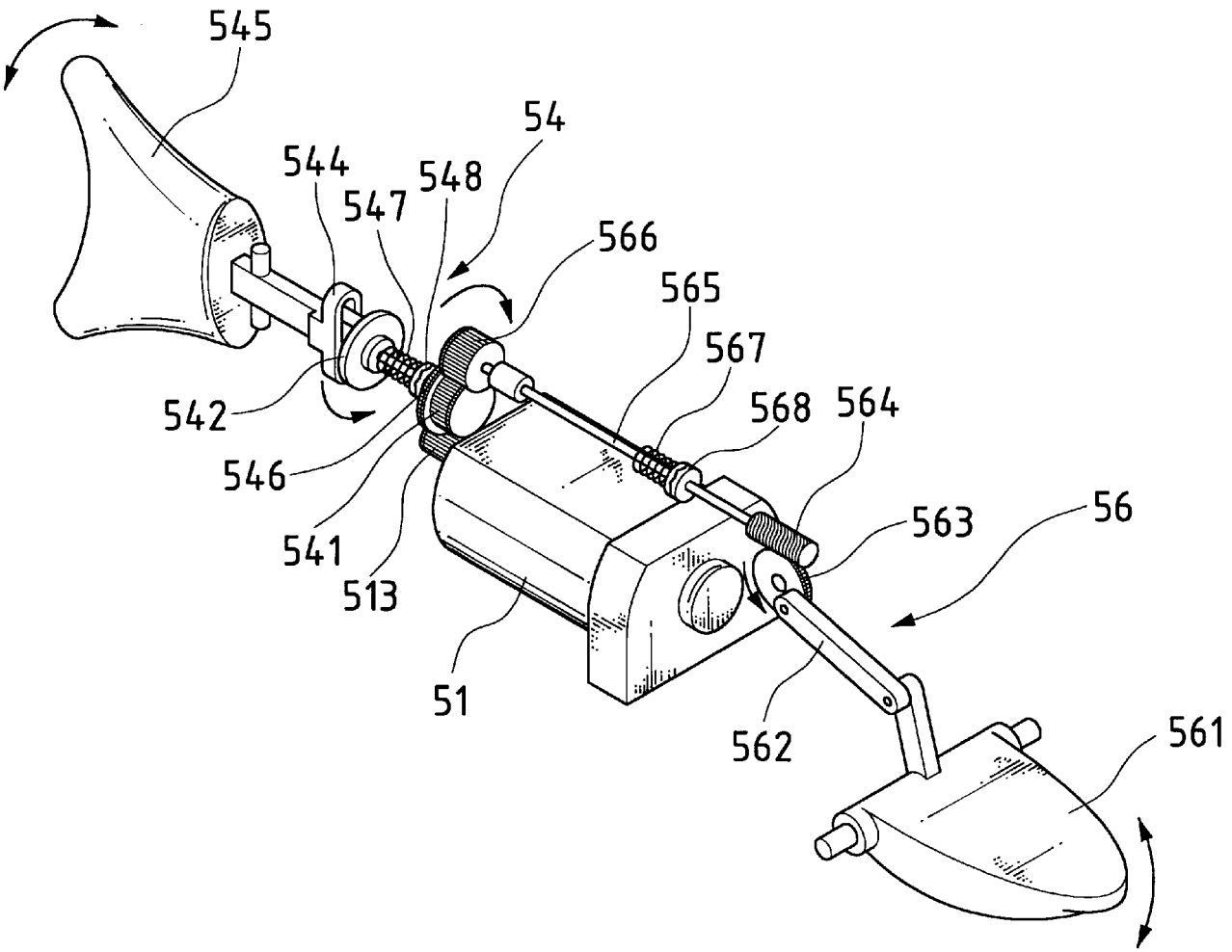
FIG. 4 shows the operation of the sinking motor, swinging mechanism and linking mechanism of the present invention.

Referring to FIG. 4, the gear set 541 of the swinging mechanism 54 has an extending central shaft 543 on which a spring 547 is fitted. A front section of the central shaft 543 is disposed with a parachute gear 548. A rear end of the central shaft is connected with an eccentric wheel 542 having an eccentric shaft positioned in a projecting plate 544 formed with an elongated channel. The projecting plate 544 is pivotally disposed on a swinging block 545 of the tail of the toy fish. The gear set 541 is engaged with a second transmission gear 566 of the transmission shaft 565. The transmission shaft 565 is disposed with a spring 567 and a parachute gear 568. A first transmission gear 564 at the front end of the transmission shaft 565 is engaged with a gear disc 563 for driving the linking lever 562 to make the lower jaw 561 move up and down.

The bite triggering mechanism 53 includes a locally rotatable driving lever 531 disposed in a biting section 57 in the mouth of the toy fish. The driving lever 531 is supported on a fixed fulcrum 532. One end of the driving lever 531 is disposed with an iron plate 534 embedded in a hole of the biting section 57. The other end thereof abuts against the shifting switch 533.

Figure 5:
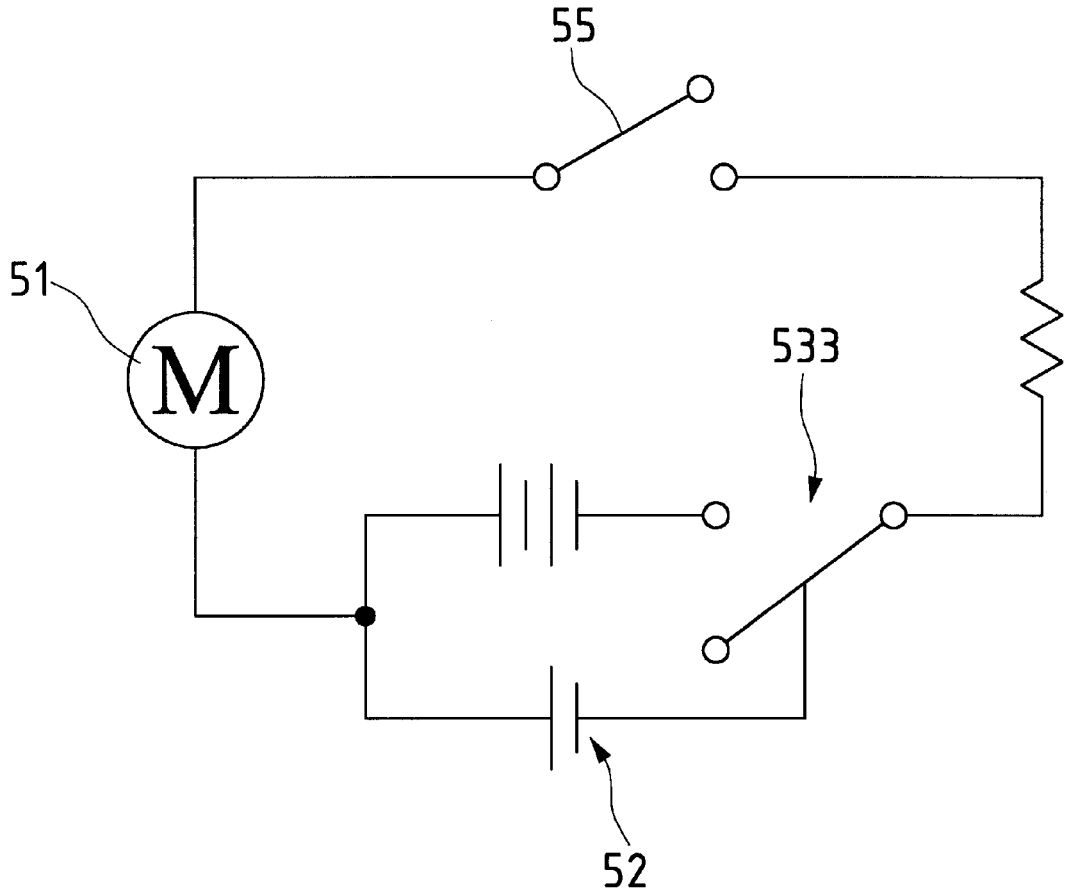
FIG. 5 is a circuit diagram of the present invention.
Figure 6:
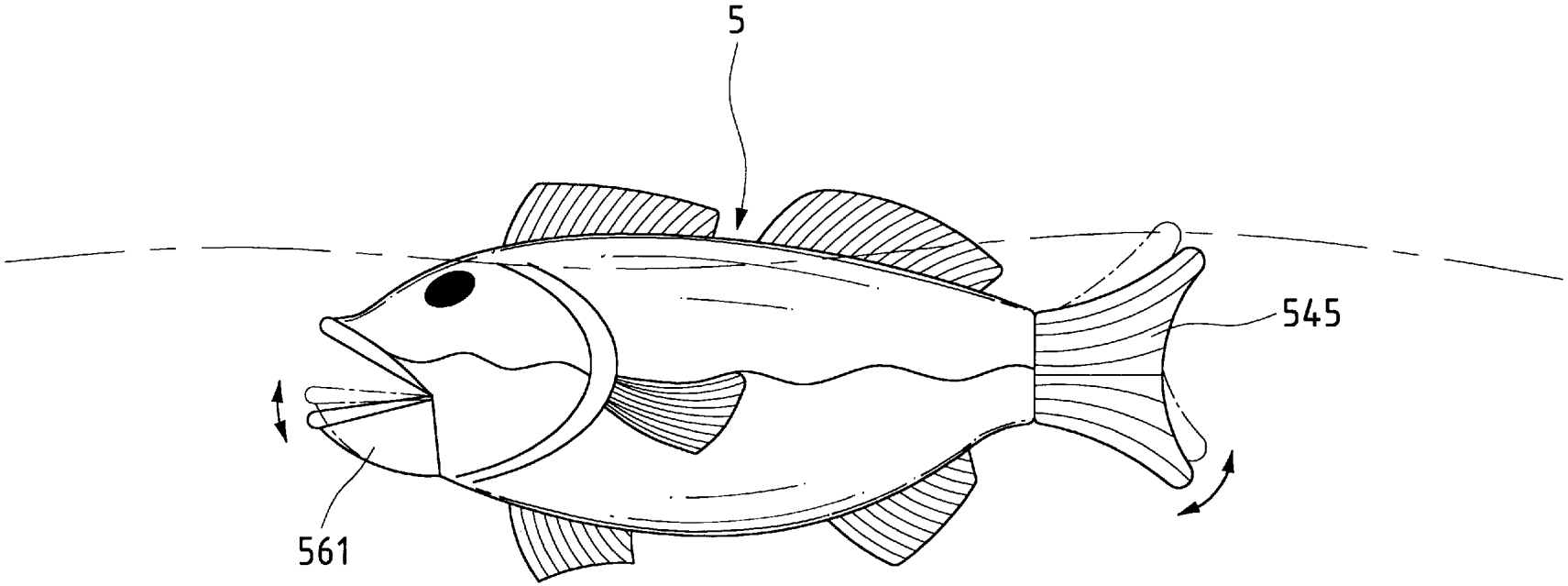
FIG. 6 shows that the toy fish of the present invention is placed in the water.
Figure 7:
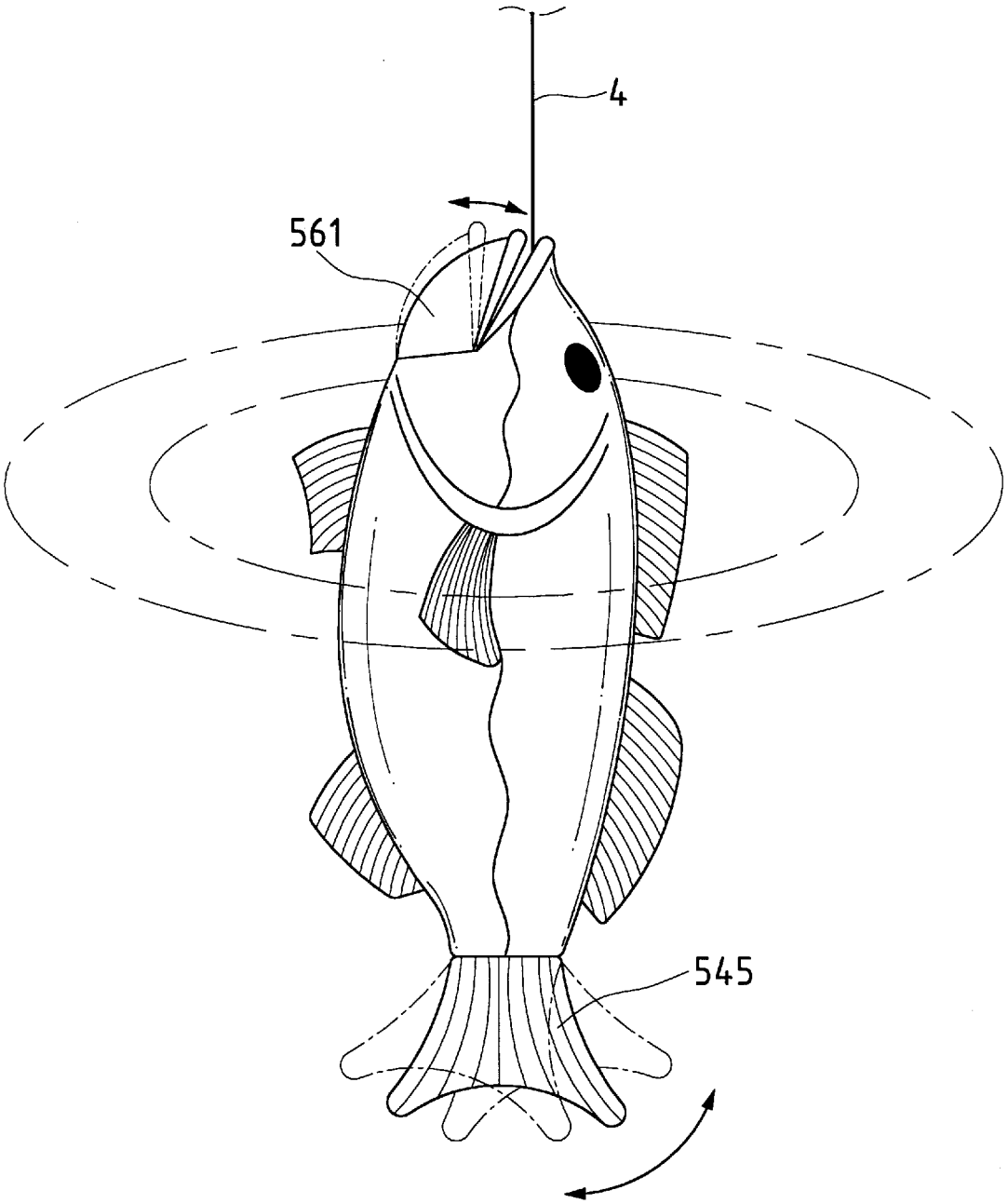
FIG. 7 shows that the toy fish of the present invention is gaffed.

Referring to FIGS. 5, 6 and 7, when the fin switch 55 of the toy fish 5 is moved to a open position to open the circuit, the sinking motor 51 is powered on only by one battery. Therefore, when placed in the water, the swinging block 545 of the fish tail and the lower jaw 561 slowly swing. When the swinging block 545 swings left and right, the toy fish 5 will swim in the water. When the magnetic bait 42 of the fishing line 4 is positioned in the biting section 57, the driving lever 531 is rotated outward and exposed outside by the magnetic attractive force of the bait 42 so as to gaff the toy fish. At this time, the other end of the driving lever 531 rotarily pushes the shifting switch 533, making three batteries together provide power for the motor 51, so that the swinging block 545 and the lower jaw 561 more violently swing. This makes a live fishing feeling to increase the entertaining effect.

Figure 11:
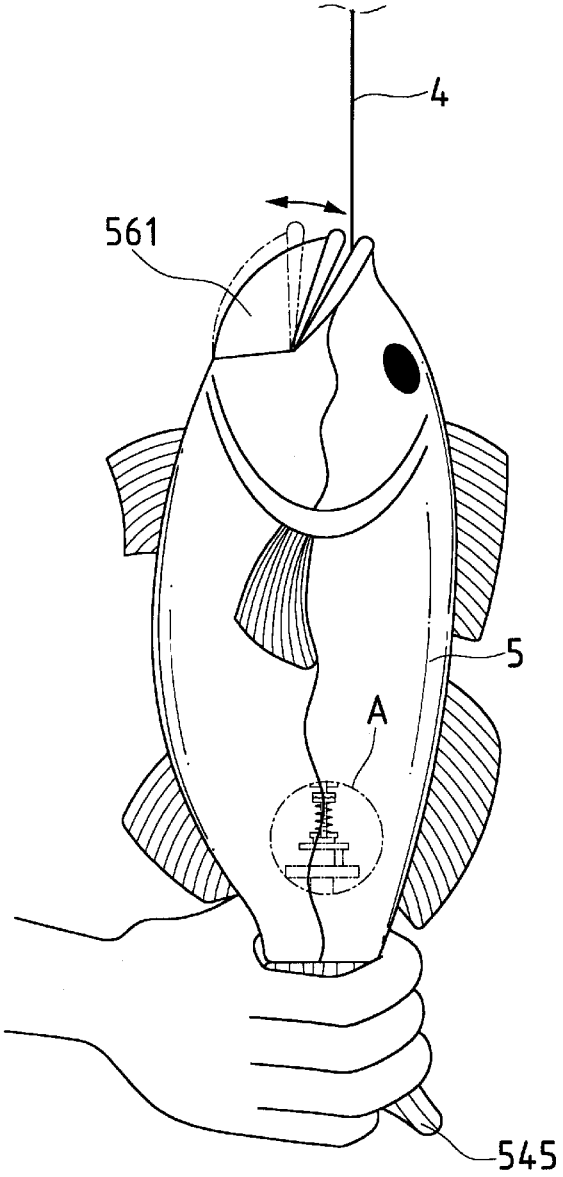
FIG. 11 shows that the swinging mechanism of the toy fish is constrained from swinging.
Figure 11A:
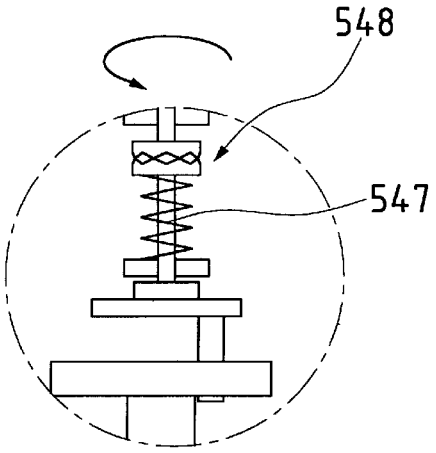
FIG. 11A is an enlarged view of part A of FIG. 11.

As shown in FIG. 11, after the toy fish 5 is gaffed, in the case that the swinging mechanism 54 is constrained without rotation, the parachute gear 548 will idle so as to protect the reducing gear 546, toothed sleeve 513 and motor 51. A similar protection means (not shown) can be applied to the lower jaw, whereby when the lower jaw 561 is constrained, the parachute gear 568 will idle so as to avoid damage of the internal mechanisms and elements and prolong the useful life of the toy fish.

Figure 9:
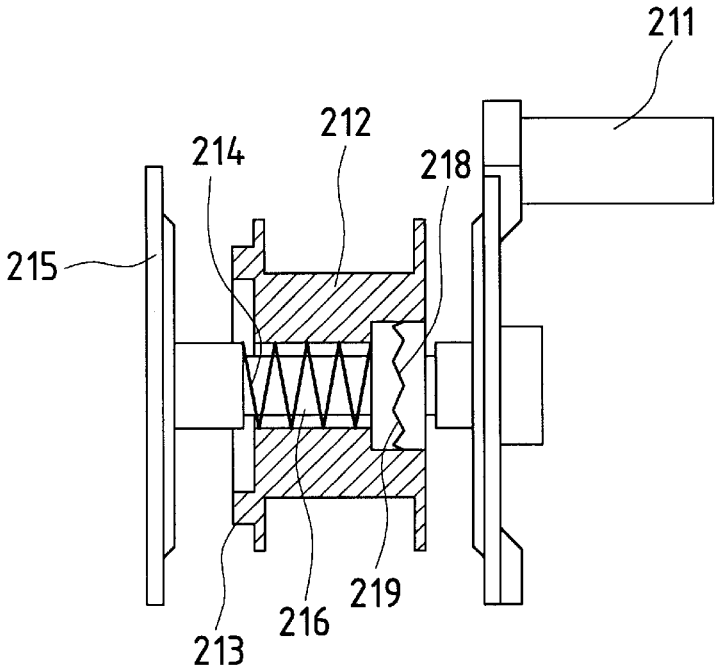
FIG. 9 is a sectional view of the line-winding mechanism in an engaged state.
Figure 10:
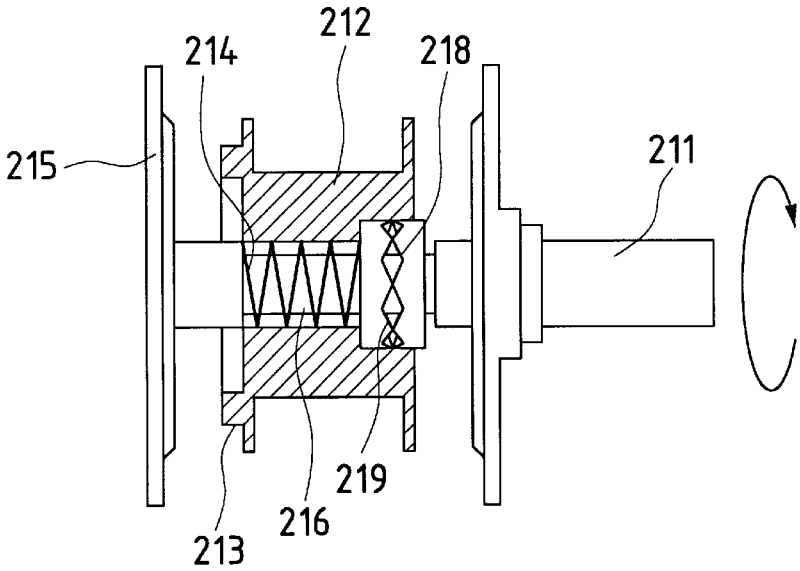
FIG. 10 is a sectional view according to FIG. 9, in which the after the fishing line is wound tight, the line-winding mechanism idles.

Furthermore, as shown in FIG. 9, in a normal using state, the adjoining face 218 of the rotary shaft 216 of the line-winding mechanism 21 is tightly engaged with the adjoining face 219 of the line reel 212, whereby the line reel 212 can be rotated by the handle 211 to wind up the fishing line. When the fishing line is wound to the end, in the case that the handle 211 is further rotated, the rotating force of the handle 211 will be greater than the resilient force of the spring 214. This will make the adjoining face 218 of the rotary shaft 216 separate from the adjoining face 219 of the line reel 212 to idle (as shown in FIG. 10). Therefore, the fishing line 4 and the fishing rod 1 are protected from being damaged.

It should be noted that the above description and accompanying drawings are only used to illustrate one embodiment of the present invention, not intended to limit the scope thereof. Any modification of the embodiment should fall within the scope of the present invention.

What is claimed is:

1. A fishing toy comprising:

a) a fishing tackle including a line-winding mechanism, a fishing line, a rear end of the fishing line being wound on the line-winding mechanism and a front end of the fishing line being provided with a magnetic bait; and b) a toy fish including a tail, a lower jaw, a motor, a battery assembly for operating the motor at a first level and a second level, a swinging mechanism driven by the motor for swinging the tail, a linking mechanism driven by the motor for moving the lower jaw, a first switch for opening a circuit and operating the motor at the first level, and a second switch having a triggering mechanism for activation by the magnetic bait to operate the motor at the second level.

2. The fishing toy of claim 1, wherein the fishing tackle further includes a spring and a rotary shaft extending through a line reel of the line-winding mechanism, a ratchet cover and a cap member with a handle coupled with two ends of the line reel.

3. The fishing toy of claim 2, wherein the line reel includes a first face and the rotary shaft includes a second face, the first and second faces being adjoining and formed with radial teeth.

4. The fishing toy of claim 2, wherein when the rotating force of the handle of the line-winding mechanism exceeds the resilient force of the spring, the rotary shaft idles.

5. The fishing toy of claim 9, wherein the motor is enclosed in a motor sheath and a motor cap.

6. The fishing toy of claim 1, wherein the swinging mechanism includes a gear set that is integrally formed with two sections of different diameters, the motor includes a toothed sleeve, the linking mechanism includes a first transmission gear, and the gear set being engaged with both the toothed sleeve and the first transmission gear.

7. The fishing toy of claim 1, wherein the swinging mechanism further includes a reducing gear and a rotary wheel, and a spring and a parachute gear are fitted with a central shaft between the reducing gear and rotary wheel.

8. The fishing toy of claim 1, wherein the linking mechanism further includes a transmission shaft and a second transmission gear, the transmission shaft being fitted with a spring and a parachute gear being disposed adjacent the second transmission gear.

* * * * *